US007649438B2

(12) United States Patent
Ikeda et al.

(10) Patent No.: US 7,649,438 B2
(45) Date of Patent: Jan. 19, 2010

(54) POSITIVE TEMPERATURE COEFFICIENT THERMISTOR DEVICE

(75) Inventors: Yutaka Ikeda, Higashiomi (JP); Hiroki Tanaka, Higashiomi (JP)

(73) Assignee: Murata Manufacturing Co., Ltd, Kyoto (JP)

( * ) Notice: Subject to any disclaimer, the term of this patent is extended or adjusted under 35 U.S.C. 154(b) by 16 days.

(21) Appl. No.: 12/099,206

(22) Filed: Apr. 8, 2008

(65) Prior Publication Data

US 2008/0180210 A1 Jul. 31, 2008

Related U.S. Application Data

(63) Continuation of application No. PCT/JP2006/319523, filed on Sep. 29, 2006.

(30) Foreign Application Priority Data

Oct. 11, 2005 (JP) ..... 2005-296017

(51) Int. Cl.
*H01C 7/10* (2006.01)

(52) U.S. Cl. ..... 338/22 R

(58) Field of Classification Search ..... 338/22 R
See application file for complete search history.

(56) References Cited

U.S. PATENT DOCUMENTS 4,954,692 A 9/1990 Shikama et al.

FOREIGN PATENT DOCUMENTS

JP 56-164257 U 12/1981
JP 63-192695 U 12/1988
JP 64-072488 A 3/1989
JP 64-077889 A 3/1989
JP 04-154075 A 5/1992
JP 7-34392 A 4/1995
JP 07-106058 A 4/1995
JP 07-263121 A 10/1995
JP 07-263122 A 10/1995
JP 3088820 U 10/2002

OTHER PUBLICATIONS

Official communication issued in counterpart International Application No. PCT/JP2006/319523, mailed on Jan. 9, 2007.

*Primary Examiner*—Anh T. Mai
*Assistant Examiner*—Joselito Baisa
(74) *Attorney, Agent, or Firm*—Keating & Bennett, LLP

(57) ABSTRACT

A positive temperature coefficient thermistor device includes a laminate of a lower insulating plate, a positive temperature coefficient thermistor element, and terminal assemblies. The laminate is disposed in a hollow portion in a metal body. The device also includes a pressure spring made of a metal plate that is bent such that the cross-sectional shape thereof in a plane substantially orthogonal to the longitudinal direction thereof is substantially constant. The pressure spring is disposed between the top surface of the hollow portion and the terminal assembly adjacent to the top surface of the hollow portion such that the pressure spring and the laminate are resiliently supported inside the hollow portion. With this structure, the pressure spring can be easily inserted without damaging electrodes of the positive temperature coefficient thermistor element, and an insulator can be easily arranged without damaging the insulator.

8 Claims, 6 Drawing Sheets

POSITIVE TEMPERATURE COEFFICIENT THERMISTOR DEVICE

BACKGROUND OF THE INVENTION

1. Field of the Invention

The present invention relates to positive temperature coefficient thermistor devices including positive temperature coefficient thermistor elements and metal bodies.

2. Description of the Related Art

Positive temperature coefficient thermistor devices including metal bodies defining radiators and positive temperature coefficient thermistor elements have been used for warm-air heaters and auxiliary heaters for air conditioners.

Japanese Examined Patent Application Publication No. 7-34390, for example, describes a positive temperature coefficient thermistor device including positive temperature coefficient thermistor elements interposed between two radiator plates that are resiliently supported by springs at both sides thereof. FIG. 1 shows the structure of the positive temperature coefficient thermistor device. The positive temperature coefficient thermistor device includes positive temperature coefficient thermistor elements 17 interposed between two radiator plates 11 and 13 that are resiliently supported by spring pins 19 at both sides thereof. The positive temperature coefficient thermistor elements 17 are insulated by a frame 15 and an insulating plate 18. In addition, electrodes on first surfaces of the positive temperature coefficient thermistor elements 17 are in contact with the radiator plate 11, and electrodes on the surfaces opposing the first surfaces are in contact with a terminal assembly 16.

Japanese Examined Patent Application Publication No. 7-34392 describes a positive temperature coefficient thermistor device including positive temperature coefficient thermistor elements biased into contact with the inner wall of a hollow metal body using a spring terminal. FIG. 2 shows the structure of the positive temperature coefficient thermistor device. Electrodes on first surfaces of positive temperature coefficient thermistor elements 27*a* and 27*b* are in contact with a metal body 25, and electrodes on first surfaces of positive temperature coefficient thermistor elements 28*a* and 28*b* are in contact with a metal body 26. The surfaces opposing the first surfaces are in contact with the spring terminal 29.

In the positive temperature coefficient thermistor device having the structure described in Japanese Examined Patent Application Publication No. 7-34390, both ends of the radiator plates are resiliently supported. Therefore, warpage of the radiator plates may cause insufficient contact of the positive temperature coefficient thermistor elements with the terminal assembly, and may cause electrode burn-out of the positive temperature coefficient thermistor elements. On the other hand, since the positive temperature coefficient thermistor device having the structure described in Japanese Examined Patent Application Publication No. 7-34392 includes the positive temperature coefficient thermistor elements, and the spring terminal inside the terminal assembly, and an insulating plate inside the hollow metal body, unwanted substances do not enter due to the hermetically sealed structure. Moreover, since the spring terminal directly pushes against the positive temperature coefficient thermistor elements, the components are reliably brought into contact with each other.

However, it is difficult to produce the positive temperature coefficient thermistor device having the structure described in Japanese Examined Patent Application Publication No. 7-34392 due to the complicated assembly of the positive temperature coefficient thermistor elements, and the spring terminal inside the hollow metal body.

Moreover, recent positive temperature coefficient thermistor devices, such as warm-air heaters and auxiliary heaters for automobiles, using positive temperature coefficient thermistor elements must have an output power of approximately 600 W. Heaters for automobiles, which use power sources of 12 volts DC, must pass currents of approximately 50 A through hollow metal bodies and spring terminals when the output power is approximately 600 W. However, with the positive temperature coefficient thermistor device having the structure described in Japanese Examined Patent Application Publication No. 7-34392, it is difficult to produce a spring terminal that is not burned out when a current of approximately 50 A passes through the terminal. That is, in order to obtain a spring terminal that can withstand high current, materials with low resistivity, for example, copper alloys such as phosphor bronze, must be used. However, when such copper alloys are used for the spring terminal having the structure described in Japanese Examined Patent Application Publication No. 7-34392, the terminal is easily deformed by the heat of the heater due to the low heat resistance of the copper alloys, which results in a reduction in the spring force. Consequently, the contact between the positive temperature coefficient thermistor elements and the hollow metal body is reduced, and as a result, the output power of the heater is reduced due to the reduced thermal conductivity. In contrast, when the spring terminal is made of stainless steel, which has high heat resistance, the electrical resistance of the spring terminal must be reduced by increasing the thickness of the material since the resistivity of the material is high. This leads to a problem that an optimum biasing force cannot be achieved due to the highly increased spring force.

Moreover, heaters for automobiles are often required to have a length of greater than about 200 mm. In this case, the spring terminal as described in Japanese Examined Patent Application Publication No. 7-34392 is bent while being inserted into the hollow metal body from an opening at an end of the hollow metal body, and thus is impractical. In addition, the spring terminal may damage the electrodes on the surfaces of the positive temperature coefficient thermistor elements while being inserted since the spring terminal is brought into direct contact with the positive temperature coefficient thermistor elements. This damage may lead to electrode burn-out.

Furthermore, the spring terminal is in contact with an insulator for insulating the spring terminal from the hollow metal body. The insulator may be damaged when a biasing force becomes concentrated in a portion of the insulator during insertion of the spring terminal. When an alumina substrate is used as the insulator, in particular, the substrate cannot function as the insulator when cracking occurs in the substrate.

In addition, silicone resin, which is a thermal conductor, is suitable for use as a soft insulator for such heaters. However, it is difficult to uniformly arrange silicone resin inside the hollow metal body described in Japanese Examined Patent Application Publication No. 7-34392.

SUMMARY OF THE INVENTION

To overcome the problems described above, preferred embodiments of the present invention provide a positive temperature coefficient thermistor device, into which a spring can be easily inserted without damaging electrodes of a positive temperature coefficient thermistor element, capable of passing a high current and having an insulator that is easily arranged therein without damaging the insulator.

A positive temperature coefficient thermistor device according to a preferred embodiment of the present invention includes a metal body having a tubular hollow portion with a substantially rectangular cross section, a tabular positive temperature coefficient thermistor element having electrodes provided on both sides thereof, two terminal assemblies, each of which is in contact with a corresponding electrode on the positive temperature coefficient thermistor element, an insulating plate that is in contact with the lower surface of the hollow portion, and a pressure spring that is in contact with one of the two terminal assemblies.

Preferably, the insulating plate, the positive temperature coefficient thermistor element, and the two terminal assemblies are disposed in the hollow portion in the metal body, and the pressure spring is disposed between the top surface of the hollow portion and the terminal assembly adjacent to the top surface of the hollow portion such that the laminate of the insulating plate, the positive temperature coefficient thermistor element, and the two terminal assemblies is resiliently supported inside the hollow portion between the pressure spring and the bottom surface of the hollow portion while the positive temperature coefficient thermistor element is interposed between the terminal assemblies.

The pressure spring is preferably a plate that is bent such that the cross-sectional shape of the spring in a plane that is orthogonal or substantially orthogonal to the longitudinal direction of the spring is substantially constant, and an end of the spring in the longitudinal direction is tapered such that the pressure spring is easily fitted into the hollow portion from an opening of the hollow portion.

Moreover, the positive temperature coefficient thermistor device preferably further includes another pressure spring, and the two pressure springs are fitted into the hollow portion from the corresponding openings of the hollow portion. With this arrangement, the pressure springs can be inserted even when the length of the metal body in the longitudinal direction thereof is large.

According to preferred embodiments of the present invention, the pressure spring is disposed between an inner surface (top surface) of the hollow portion and one of the terminal assemblies (adjacent to the top surface) while the positive temperature coefficient thermistor element is interposed between the two terminal assemblies. Thus, the pressure spring can be easily fitted into the hollow portion without damaging the electrodes of the positive temperature coefficient thermistor element. Moreover, since the pressure spring is not a terminal assembly that is brought into direct contact with the electrodes of the positive temperature coefficient thermistor element, the terminal is not burned out even when a high current is applied. Furthermore, since the terminal assemblies can be biased toward the electrodes of the positive temperature coefficient thermistor element with an appropriate pushing force, a high current can be applied to the components. Moreover, since the positive temperature coefficient thermistor element is pressed toward one side of the hollow portion in a metal body using the spring, the heat generated at the positive temperature coefficient thermistor element can be easily transferred to the insulating plate and the metal body, which provide improved heat dissipation. Furthermore, the terminal assemblies and the positive temperature coefficient thermistor element can be easily insulated from the metal body by inserting only the insulating plate into the hollow portion.

According to preferred embodiments of the present invention, the pressure spring having a tapered end is inserted into the hollow portion in the metal body from the opening of the hollow portion. Therefore, the laminate of the insulating plate, the positive temperature coefficient thermistor element, and the terminal assemblies can be easily disposed inside the hollow portion in the metal body. Moreover, the pressure spring is not readily obstructed by the metal body and the terminal assemblies while being inserted. Thus, short circuiting caused by metal chips scraped from the metal body and the terminal assemblies is prevented.

According to preferred embodiments of the present invention, the device may include two pressure springs, and the pressure springs can be inserted into the hollow portion from the corresponding openings of the hollow portion. With this arrangement, preferred embodiments of the present invention can be used for elongated positive temperature coefficient thermistor devices.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

A positive temperature coefficient thermistor device according to a first preferred embodiment of the present invention will now be described with reference to FIGS. 3 to 5.

Figure 1:
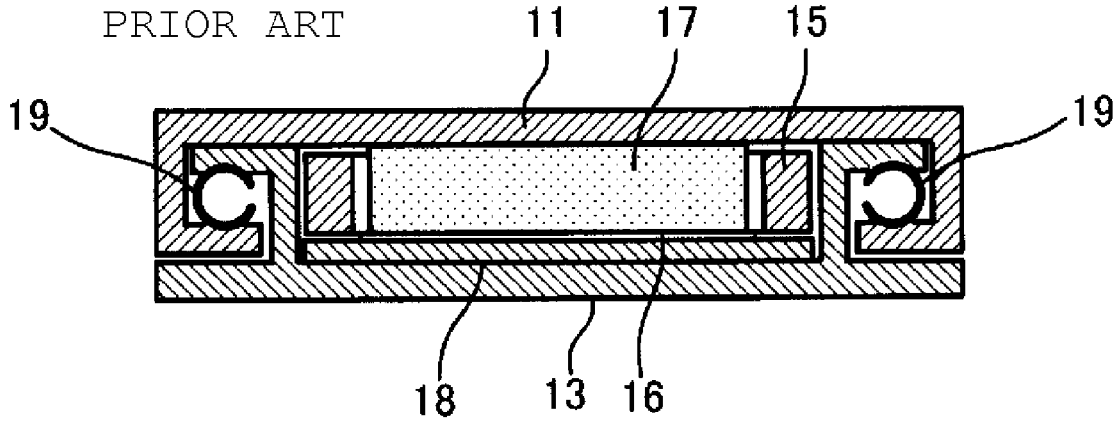
FIG. 1 PRIOR ART
FIG. 1 illustrates the structure of a positive temperature coefficient thermistor device described in Japanese Examined Patent Application Publication No. 7-34390.
Figure 2:
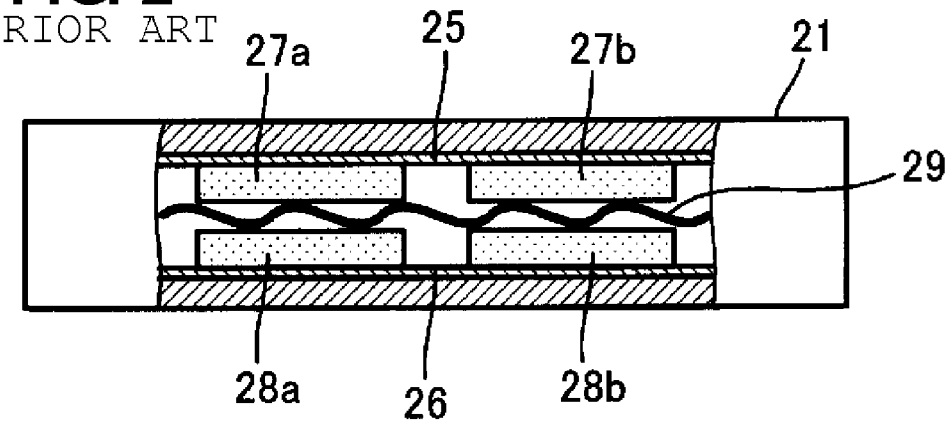
FIG. 2 PRIOR ART
FIG. 2 illustrates the structure of a positive temperature coefficient thermistor device described in Japanese Examined Patent Application Publication No. 7-34392.
Figure 3:
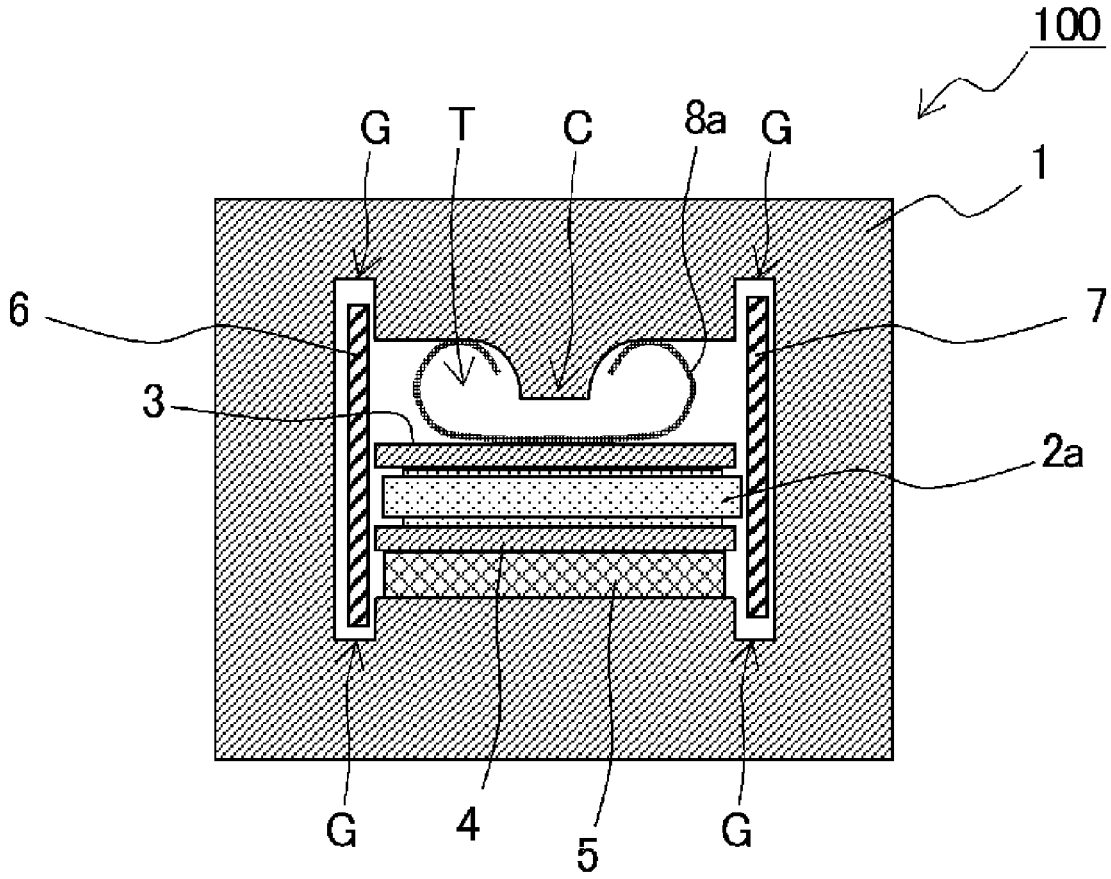
FIG. 3 is a cross-sectional view taken along a plane that is orthogonal or substantially orthogonal to the longitudinal direction of a positive temperature coefficient thermistor device according to a first preferred embodiment of the present invention.

FIG. 3 is a cross-sectional view taken in a plane orthogonal to the longitudinal direction of the positive temperature coefficient thermistor device. FIG. 4B is a longitudinal sectional view taken along the central axis in the longitudinal direction, and FIG. 4A is a transverse sectional view in the vicinity of the top surface of a hollow portion in a metal body.

Figure 4A:
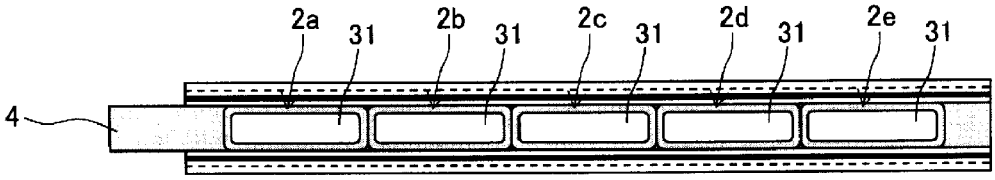
FIGS. 4A and 4B are cross-sectional views in the longitudinal direction of the positive temperature coefficient thermistor device.
Figure 4B:
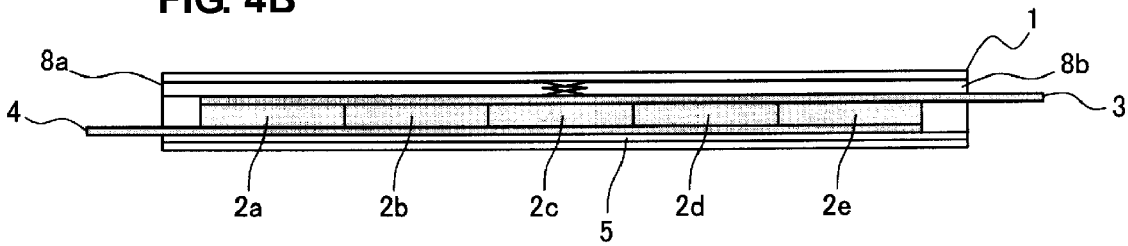

As shown in FIGS. 3, 4A, and 4B, a metal body 1 includes a tubular hollow portion T having a cross section in a plane that is orthogonal or substantially orthogonal to the longitudinal direction thereof that is substantially rectangular. As shown in FIGS. 4A and 4B, the positive temperature coefficient thermistor device preferably includes, for example, five rectangular-parallelepiped positive temperature coefficient thermistor elements 2*a* to 2*e* having electrodes 31 provided on the top and bottom surfaces thereof. The positive temperature coefficient thermistor device further includes slender terminal assemblies 3 and 4 that are brought into contact with the electrodes 31 on the positive temperature coefficient thermistor element 2*a* to 2*e*. Moreover, a lower insulating plate 5 is disposed between the lower terminal assembly 4 and the bottom surface of the hollow portion T.

As shown in FIG. 3, side insulating plates 6 and 7 are disposed between the side surfaces of the hollow portion T and both sides of the laminate of the two terminal assemblies 3 and 4 and the positive temperature coefficient thermistor element 2*a*. The hollow portion T in the metal body 1 includes grooves G in which the side insulating plates 6 and 7 are disposed and fixed.

A pressure spring 8*a* is made of a metal plate that is bent such that the cross-sectional shape thereof in a plane orthogonal or substantially orthogonal to the longitudinal direction is substantially constant regardless of the position in the longitudinal direction, and is disposed between the upper terminal assembly 3 and the top surface of the hollow portion T. With this arrangement, the positive temperature coefficient thermistor element 2*a* and the lower insulating plate 5 are resiliently supported between the pressure spring 8*a* and the bottom surface of the hollow portion T while the positive temperature coefficient thermistor element 2*a* interposed between the terminal assemblies 3 and 4.

A convex engaging portion C that is engaged with the pressure spring 8*a* is provided on the top surface of the hollow portion T. This locates the pressure spring 8*a* with respect to the hollow portion T when the pressure spring 8*a* is fitted into the hollow portion T from an opening of the hollow portion T. With this structure, the pressure spring 8*a* and a pressure spring 8*b* can be smoothly inserted in the longitudinal direction.

As shown in FIGS. 4A and 4B, the terminal assemblies 3 and 4 having the positive temperature coefficient thermistor elements 2*a* to 2*e* interposed therebetween project from the corresponding openings of the hollow portion T in the metal body 1. The projecting portions function as terminals of the positive temperature coefficient thermistor device. The pressure springs 8*a* and 8*b* have substantially the same shape. The pressure springs 8*a* and 8*b* are fitted into the hollow portion T in the metal body 1 from the corresponding openings of the hollow portion T in the longitudinal direction, and are brought into contact with each other substantially at the center of the hollow portion T.

These components define a heating unit 100.

Figure 5:
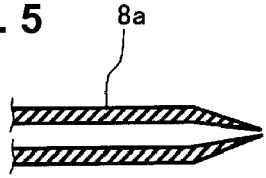
FIG. 5 illustrates the shape of a pressure spring used in the positive temperature coefficient thermistor device.

FIG. 5 is a cross-sectional view illustrating the shape of the tip of the pressure spring 8*a*. As shown in FIG. 5, one of the ends of the pressure spring 8*a* is tapered. The other pressure spring 8*b* shown in FIGS. 4A and 4B has substantially the same shape. These springs can be easily fitted into the hollow portion T in the metal body 1 from the openings of the hollow portion T due to the tapered tips.

The metal body 1 shown in FIGS. 3, 4A, and 4B is preferably formed by extruding aluminum, and has a length of about 250 mm and a section of about 12 mm×about 10 mm, for example. The side insulating plates 6 and 7 are preferably made of mica. The lower insulating plate 5 is an alumina substrate having a thickness of about 1 mm, and the terminal assemblies 3 and 4 are made of phosphor bronze having a thickness of about 0.35 mm, for example. The dimensions of each of the positive temperature coefficient thermistor elements 2*a* to 2*e* are about 30 mm in length, about 6 mm in width, and about 1.5 mm in thickness, for example.

A positive temperature coefficient thermistor device according to the first preferred embodiment does not experience any meltdown of the terminal assemblies 3 and 4 even when passing a current of about 50 A.

The positive temperature coefficient thermistor device according to the first preferred embodiment is assembled as follows.

First, the side insulating plates 6 and 7 are inserted into the hollow portion T from one of the openings of the hollow portion T such that the side ends of the plates are slid along the grooves G.

Next, the laminate of the lower insulating plate 5, the terminal assemblies 3 and 4, and the positive temperature coefficient thermistor elements 2*a* to 2*e* is inserted into the hollow portion T from one of the openings of the hollow portion T.

Subsequently, the pressure springs 8*a* and 8*b* are inserted into the hollow portion T from the corresponding openings of the hollow portion T while being engaged with the engaging portion C.

The effects of the positive temperature coefficient thermistor device according to the first preferred embodiment are as follows.

Both sides of the positive temperature coefficient thermistor elements 2*a* to 2*e* are held between the terminal assemblies 3 and 4, and the pressure springs 8*a* and 8*b* are disposed between the top surface of the hollow portion T in the metal body 1 and the upper terminal assembly 3, that is, the pressure springs 8*a* and 8*b* are not used as terminals. Thus, it is not necessary to consider the current capacity of the pressure springs 8*a* and 8*b*, which enables an optimum spring design. Moreover, the device can be readily used for high current applications, such as heaters for automobiles, since the materials and the thicknesses of the terminal assemblies 3 and 4 can be flexibly designed.

The pressure springs 8*a* and 8*b* are metal plates that are bent (rolled) such that the cross-sectional shapes thereof in a plane orthogonal or substantially orthogonal to the longitudinal direction are substantially constant. Thus, the springs are not easily buckled or bent during insertion.

Since the pressure springs 8*a* and 8*b* are disposed between the inner surface (top surface) of the hollow portion T and the terminal assembly (terminal assembly 3), the terminal assemblies 3 and 4 are pressed toward the electrode surfaces of the positive temperature coefficient thermistor elements 2*a* to 2*e* substantially perpendicular to the electrode surfaces without damaging the electrodes of the positive temperature coefficient thermistor elements 2*a* to 2*e*. This prevents a poor connection between the terminal assemblies 3 and 4 and the electrodes of the positive temperature coefficient thermistor elements 2*a* to 2*e*.

Since the grooves G into which the side insulating plates 6 and 7 are disposed are provided inside the hollow portion T, the side insulating plates 6 and 7 can be easily inserted, and can be disposed inside the hollow portion before the laminate of the lower insulating plate 5, the terminal assemblies 3 and 4, and the positive temperature coefficient thermistor elements 2*a* to 2*e* is inserted. Thus, the laminate can also be easily inserted. In the case of, in particular, auxiliary heaters for automobiles having a large length of, for example, about 150 mm or more, and a small aperture of, for example, about 10 mm×about 6 mm, it is difficult to arrange silicone resin inside the hollow portion as in the known technology. However, according to the first preferred embodiment, the insulating plates made of mica or alumina can be easily assembled by inserting the insulating plates from the opening of the hollow portion.

Since the engaging portion C with which the pressure springs 8*a* and 8*b* are engaged is provided inside the hollow portion T in the metal body 1, the pressure springs 8*a* and 8*b* can be easily inserted without being displaced. With this arrangement, the pressing force of the terminal assemblies 3 and 4 toward the positive temperature coefficient thermistor elements 2*a* to 2*e* is substantially uniform.

Each one of the ends of the pressure springs 8*a* and 8*b* is tapered. Thus, it is not necessary to squeeze the pressure springs 8*a* and 8*b* into the hollow portion T during insertion of the pressure springs 8*a* and 8*b*, which facilitates insertion of the pressure springs 8*a* and 8*b*.

Since the pressure springs 8*a* and 8*b* are inserted into the hollow portion T from the corresponding openings of the hollow portion T in the metal body 1, the length of the pressure springs 8*a* and 8*b* can be reduced. With this arrangement, the pressure springs 8*a* and 8*b* can be inserted more easily. That is, damage to the springs can be prevented due to a reduced insertion force.

Next, a positive temperature coefficient thermistor device according to a second preferred embodiment of the present invention will be described with reference to FIGS. 6A and 6B.

Figure 6A:
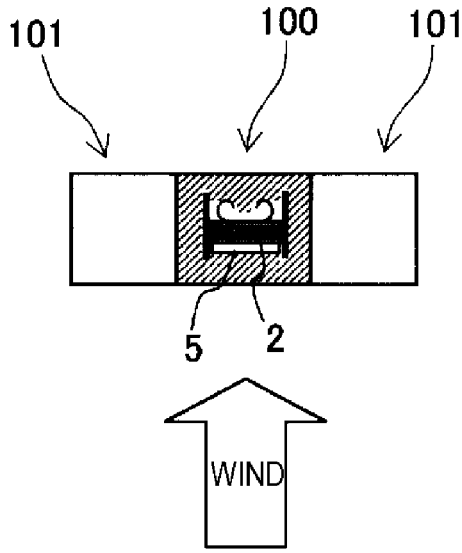
FIGS. 6A and 6B illustrate the structure of a positive temperature coefficient thermistor device according to a second preferred embodiment of the present invention.
Figure 6B:
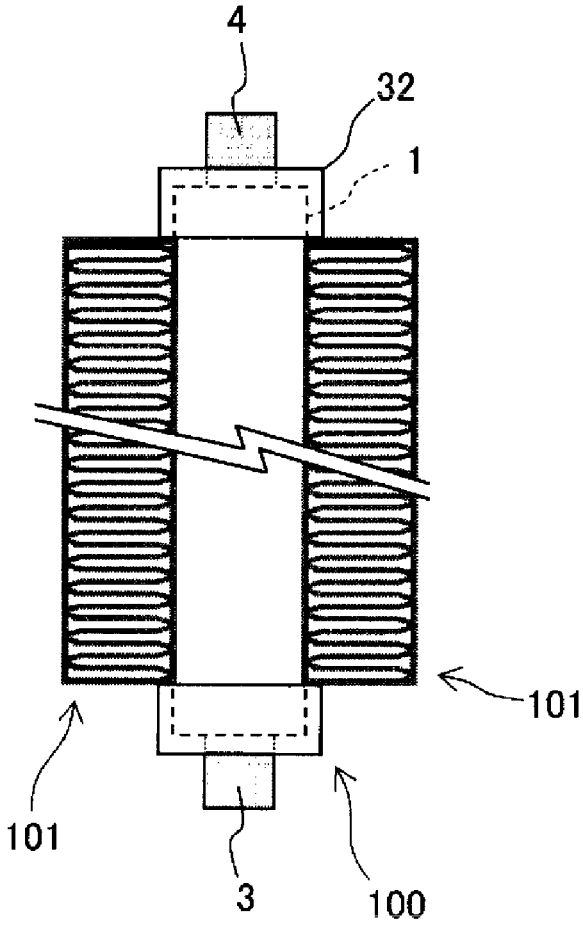

FIG. 6A is a cross-sectional view taken in a plane orthogonal or substantially orthogonal to the longitudinal direction of the positive temperature coefficient thermistor device according to the second preferred embodiment, and FIG. 6B is a bottom view. The positive temperature coefficient thermistor device according to the second preferred embodiment has substantially the same structure as that shown in FIGS. 3, 4A, and 4B except for radiating units 101. That is, the heating unit 100 shown in FIGS. 6A and 6B is substantially the same as that in the positive temperature coefficient thermistor device shown in the first preferred embodiment. The radiating units 101 are attached to or integrated with the metal body 1 of the heating unit 100. As shown in FIG. 6B, the radiating units 101 are aluminum corrugated fins, and are brazed to surfaces (both side surfaces) orthogonal or substantially orthogonal to the surface of the metal body 1 to which the positive temperature coefficient thermistor elements 2 are thermally bound via the lower insulating plate 5. Moreover, the orientation of the corrugated fins is set such that air blown on the thermally bound surface of the metal body 1 passes through the corrugated fins.

As shown in FIGS. 6A and 6B, both ends of the metal body 1 are covered with frames 32. These frames 32 are preferably made of polyphenylene sulfide (PPS).

Next, a positive temperature coefficient thermistor device according to a third preferred embodiment of the present invention will be described with reference to FIGS. 7 and 8.

Figure 7:
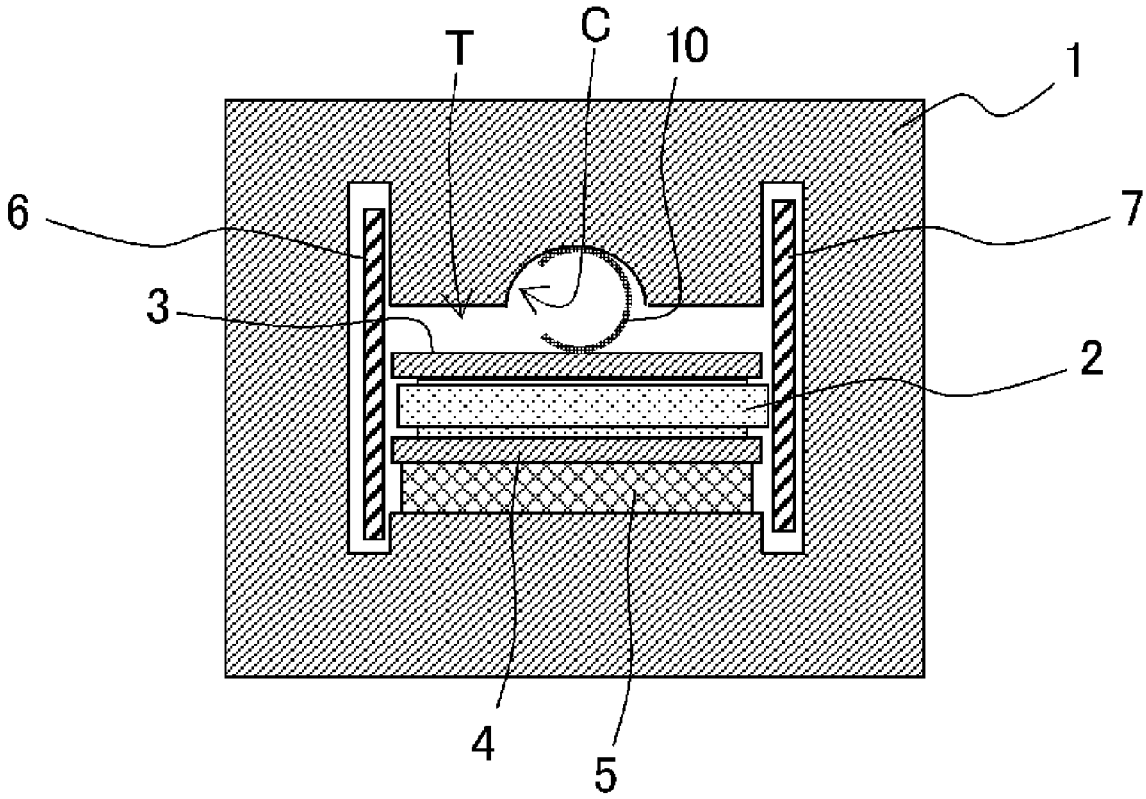
FIG. 7 illustrates the structure of a positive temperature coefficient thermistor device according to a third preferred embodiment of the present invention.
Figure 8:
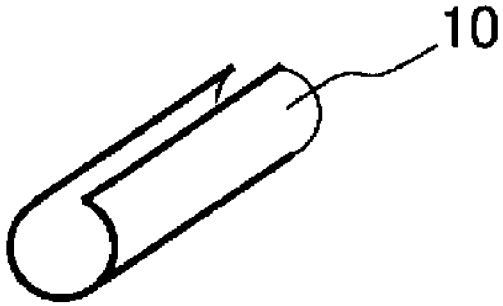
FIG. 8 illustrates the shape of a pressure spring used in the positive temperature coefficient thermistor device.

FIG. 7 is a cross-sectional view taken in a plane orthogonal or substantially orthogonal to the longitudinal direction of the device, and FIG. 8 is a fragmentary perspective view of a pressure spring used in the positive temperature coefficient thermistor device.

In the first and second preferred embodiments, the pressure springs are flattened along the surfaces of the terminal assemblies 3 and 4 and the positive temperature coefficient thermistor elements 2. The third preferred embodiment uses a substantially cylindrical pressure spring 10. With this arrangement, the engaging portion C provided inside the hollow portion T in the metal body 1 has a substantially semicircular groove shape.

When the widths of the terminal assemblies 3 and 4 and the positive temperature coefficient thermistor elements 2 are relatively small, the pressure spring 10 can be linearly brought into contact with the terminal assembly 3.

Next, other shapes of pressure springs used in a positive temperature coefficient thermistor device according to a fourth preferred embodiment of the present invention will be described with reference to FIGS. 9A and 9B.

Figure 9A:
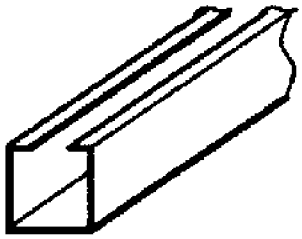
FIGS. 9A and 9B illustrate the shapes of pressure springs used in a positive temperature coefficient thermistor device according to a fourth preferred embodiment of the present invention.
Figure 9B:
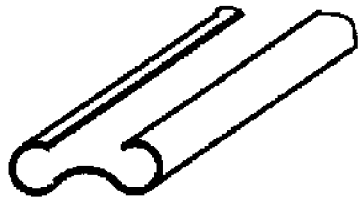

The pressure springs fitted into the hollow portion T in the metal body 1 are not limited to those shown in the first to third preferred embodiments, and may have a substantially rectangular cross section as shown in, for example, FIG. 9A. Moreover, the pressure springs may have a plurality of linear portions that are brought into contact with the terminal assembly as shown in FIG. 9B. The cross sections of the pressure springs may have any other suitable shape as long as the pressure springs press the laminate of the lower insulating plate 5, the terminal assemblies 3 and 4, and the positive temperature coefficient thermistor elements 2 inside the hollow portion at a predetermined pushing force.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A positive temperature coefficient thermistor device comprising:

a metal body including a tubular hollow portion having a substantially rectangular cross section;

a tabular positive temperature coefficient thermistor element having electrodes provided on both sides thereof;

two terminal assemblies, each of which is in contact with a corresponding one of the electrodes on the positive temperature coefficient thermistor element;

an insulating plate that is in direct contact with the lower surface of the hollow portion; and a pressure spring in direct contact with one of the two terminal assemblies; wherein the insulating plate, the positive temperature coefficient thermistor element, and the two terminal assemblies are disposed in the hollow portion in the metal body; and the pressure spring is disposed between an upper surface of the hollow portion and the terminal assembly adjacent to the top surface of the hollow portion such that the laminate of the insulating plate, the positive temperature coefficient thermistor element, and the two terminal assemblies is resiliently supported inside the hollow portion between the pressure spring and the lower surface of the hollow portion while the positive temperature coefficient thermistor element is interposed between the terminal assemblies.

2. The positive temperature coefficient thermistor device according to claim 1, wherein the pressure spring is a plate that is bent such that a cross-sectional shape of the pressure spring in a plane substantially orthogonal to a longitudinal direction of the spring is substantially constant, and an end of the pressure spring in the longitudinal direction is tapered such that the pressure spring can be easily fitted into the hollow portion from an opening of the hollow portion.

3. The positive temperature coefficient thermistor device according to claim 1, wherein the device further comprises another pressure spring, and the two pressure springs are fitted into the hollow portion from corresponding openings of the hollow portion.

4. The positive temperature coefficient thermistor device according to claim 1, further comprising side insulating plates disposed between side surfaces of the tubular hollow portion and sides of the positive temperature coefficient thermistor element.

5. The positive temperature coefficient thermistor device according to claim 1, wherein the upper surface of the hollow portion includes a convex engaging portion that is engaged with the pressure spring.

6. The positive temperature coefficient thermistor device according to claim 1, wherein the pressure spring includes a flattened portion that is in contact with the one of the two terminal assemblies.

7. The positive temperature coefficient thermistor device according to claim 1, wherein the pressure spring has a substantially cylindrical cross section.

8. The positive temperature coefficient thermistor device according to claim 1, wherein the pressure spring has a substantially rectangular cross section.

* * * * *